US007427838B2

(12) United States Patent
Hosoya

(10) Patent No.: US 7,427,838 B2
(45) Date of Patent: Sep. 23, 2008

(54) LIGHT SOURCE CONTROLLING CIRCUIT AND PORTABLE ELECTRONIC APPARATUS

(75) Inventor: Hideyuki Hosoya, Saitama (JP)

(73) Assignee: NEC Corporation, Tokyo (JP)

( * ) Notice: Subject to any disclaimer, the term of this patent is extended or adjusted under 35 U.S.C. 154(b) by 352 days.

(21) Appl. No.: 11/111,707

(22) Filed: Apr. 22, 2005

(65) Prior Publication Data

US 2006/0238130 A1 Oct. 26, 2006

(30) Foreign Application Priority Data

Apr. 22, 2004 (JP) ..... 2004-126549

(51) Int. Cl.
*H05B 37/00* (2006.01)

(52) U.S. Cl. ..... 315/119; 315/309; 345/82; 345/102

(58) Field of Classification Search ..... 315/51, 315/119, 121, 122, 123, 224, 291, 307, 309; 345/82, 102, 211, 212; 455/566, 572, 574
See application file for complete search history.

(56) References Cited

U.S. PATENT DOCUMENTS

| | | | | |
|---|---|---|---|---|
| 5,598,068 | A * | 1/1997 | Shirai | 315/185 R |
| 6,107,985 | A | 8/2000 | Walukas et al. | 345/102 |
| 6,256,007 | B1 * | 7/2001 | Walukas et al. | 345/102 |
| 6,538,394 | B2 * | 3/2003 | Volk et al. | 315/291 |
| 7,075,596 | B2 * | 7/2006 | Hosoda | 349/72 |
| 2002/0135572 | A1 * | 9/2002 | Weindorf | 345/204 |

FOREIGN PATENT DOCUMENTS

| | | |
|---|---|---|
| CA | 2457620 | 2/2003 |
| FR | 2845559 | 4/2004 |
| JP | 6-53551 | 2/1994 |
| JP | 2001-66675 | 3/2001 |
| JP | 2001-242510 | 9/2001 |
| JP | 2002-156690 | 5/2002 |
| JP | 2003-133065 | 5/2003 |
| JP | 2003-241266 | 8/2003 |
| JP | 2004-22370 | 1/2004 |

* cited by examiner

*Primary Examiner*—Douglas W. Owens
*Assistant Examiner*—Ephrem Alemu
(74) *Attorney, Agent, or Firm*—Young & Thompson

(57) ABSTRACT

A light source controlling circuit controls a light source outputting continuous light. The light source controlling circuit has a power supply circuit supplying an electric power to the light source, a light source monitoring circuit monitoring a state of the light source, and a control circuit outputting a first control signal to control the light source is controlled. The light source monitoring circuit outputs a second control signal to control the light source in correspondence to a state of the light source. A portable electronic apparatus has a light source outputting continuous light, an image pickup device, and the light source controlling circuit. The light source controlling circuit, for example, controls ON/OFF of the light source in accordance with a temperature of the light source detected by the light source monitoring circuit.

22 Claims, 6 Drawing Sheets

LIGHT SOURCE CONTROLLING CIRCUIT AND PORTABLE ELECTRONIC APPARATUS

BACKGROUND OF THE INVENTION

1. Field of the Invention

The present invention relates in general to a light source controlling circuit for controlling a light source for emitting continuous light and a portable electronic apparatus having a camera function, and more particularly to a circuit for detecting an abnormal state of the light source to stop the emission of light from the light source.

2. Description of the Related Art

In recent years, many portable electronic apparatuses such as a mobile telephone have an imaging element and can operate as cameras. Some portable electronic apparatuses each having an imaging element have light sources with each of which the photography can be made under an environment having low illuminance. In general, however, a temperature of a light source built in a camera reaches a high temperature during the operation, and hence harms an electronic apparatus within the camera in some cases. JP 2001-66675 A, JP 2001-242510 A, and JP 2002-156690 A disclose techniques for suppressing heat generation of a flash light emitting device such as a xenon lamp built in a camera. However, JP 2001-66675 A, JP 2001-242510 A, and JP 2002-156690 A do not treat a continuous light emitting device as an object. Consequently, any of those disclosed techniques cannot be applied to a problem with respect to the heat generation of the light source for emitting continuous light which the present invention aims at solving.

Referring to FIG. 1, there is shown an example of a control circuit for a light emitting diode (LED) mounted within a portable electronic apparatus having an imaging element. The LED 103 is a light source for the portable electronic apparatus and serves to emit continuous light. A light source controlling circuit shown in FIG. 1 includes the LED 103, an LED power supply circuit 102, a CPU 101, and a power supply 104. The LED 103 emits a sufficient quantity of continuous light to a subject under an environment having low illuminance. For example, the LED 103 may be configured in the form of an LED array having a plurality of LEDs connected in series with each other. The LED power supply circuit 102 adjusts a voltage supplied from the power supply 104 into a predetermined voltage, which is in turn supplied to the LED 103. The power supply 104 operates as a power supply not only for the LED 103 but also for the portable electronic apparatus, and for example, is any one of various kinds of batteries. The CPU 101 controls the overall portable electronic apparatus, and controls an operation of the LED power supply circuit 102. However, in the above light source controlling circuit, even when the voltage supplied to the LED 103 is held at a predetermined value, a temperature of the LED 103 reaches a temperature equal to or larger than the predetermined value due to a short circuit or the like in some cases. Since the above conventional light source controlling circuit does not include means for monitoring a lighting state or a heat radiation quantity (or a temperature) of the LED 103, the malfunction of the light source as described above is not detected.

SUMMARY OF THE INVENTION

The present invention has been made in view of the above-mentioned problems, and therefore has an object to provide a light source controlling circuit having the following structure.

According to an aspect of the present invention, a light source controlling circuit controls a light source that outputs continuous light. The light source controlling circuit includes: a power supply circuit that supplies an electric power to the light source; a light source monitoring circuit that monitors a state of the light source; and a control circuit that outputs a first control signal to control the light source. The light source monitoring circuit outputs a second control signal to control the light source in correspondence to the state of the light source.

According to another aspect of the present invention, a portable electronic apparatus includes: an imaging device; a light source that outputs continuous light; a power supply circuit that supplies an electric power to the light source; a light source monitoring circuit that monitors a state of the light source; and a control circuit that outputs a first control signal to control the light source. The light source monitoring circuit outputs a second control signal to control the light source in correspondence to the state of the light source.

When the light source monitoring circuit detects malfunction of the light source, the light source monitoring circuit can output the second control signal to the power supply circuit to stop an operation of the power supply circuit. When the light source monitoring circuit detects malfunction of the light source, the light source monitoring circuit can output the second control signal to the power supply circuit to stop an operation of the power supply circuit.

According to the present invention, the malfunction of the light source for outputting continuous light is speedily suppressed.

BRIEF DESCRIPTION OF THE DRAWINGS

The above and other objects, features and advantages of the present invention will become apparent form the following detailed description when taken with the accompanying drawings in which.

DETAILED DESCRIPTION OF THE PREFERRED EMBODIMENTS

Preferred embodiments of a light source controlling circuit and a portable electronic apparatus of the present invention will hereinafter be described in detail with reference to the accompanying drawings.

Figure 1:
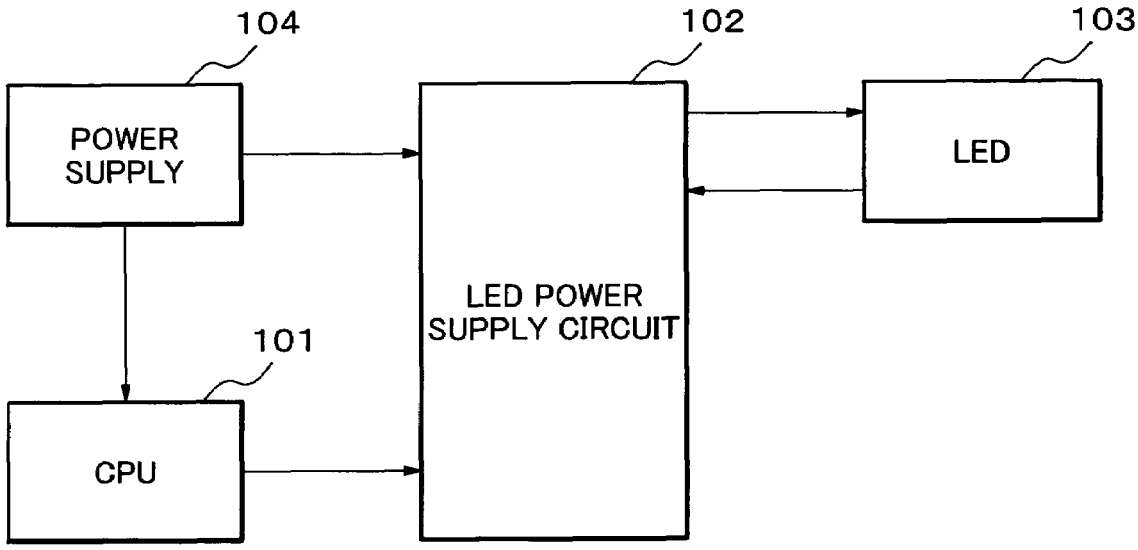
PRIOR ART FIG.1
FIG. 1 is a block diagram of an example of a conventional light source controlling circuit.
Figure 2:
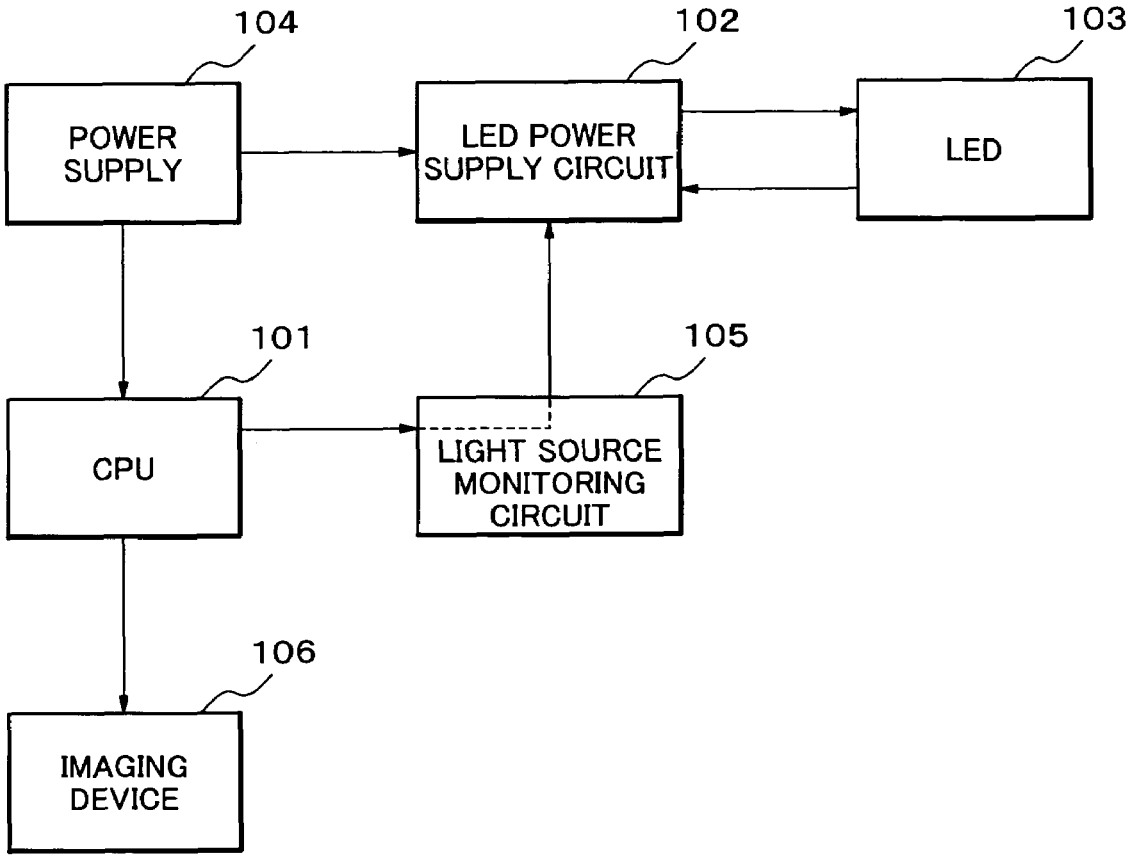
FIG. 2 is a block diagram of a light source controlling circuit according to an embodiment of the present invention.

Referring to FIG. 2, a light source controlling circuit includes a CPU 101, an LED power supply circuit 102, an LED 103, a power supply 104, and a light source monitoring circuit 105. A portable electronic apparatus includes the above light source controlling circuit, an imaging device 106, and other circuits (not shown). The CPU 101 outputs an operation control signal to the LED power supply circuit 102 through the light source monitoring circuit 105. When the operation control signal is at a high level, the LED power supply circuit 102 turns ON the LED 103. On the other hand, when the operation control signal is at a low level, the LED power supply circuit 102 turns OFF the LED 103. The light source monitoring circuit 105 monitors a temperature of the LED 103 during an ON state. When the light source monitoring circuit 105 detects abnormality of the temperature of the LED 103, the light source monitoring circuit 105 outputs a signal at a low level to the LED power supply circuit 102 to turn OFF the LED 103 irrespective of a state of the operation control signal outputted from the CPU 101. The CPU can also control the imaging device 106 and the overall portable electric apparatus.

Figure 3:
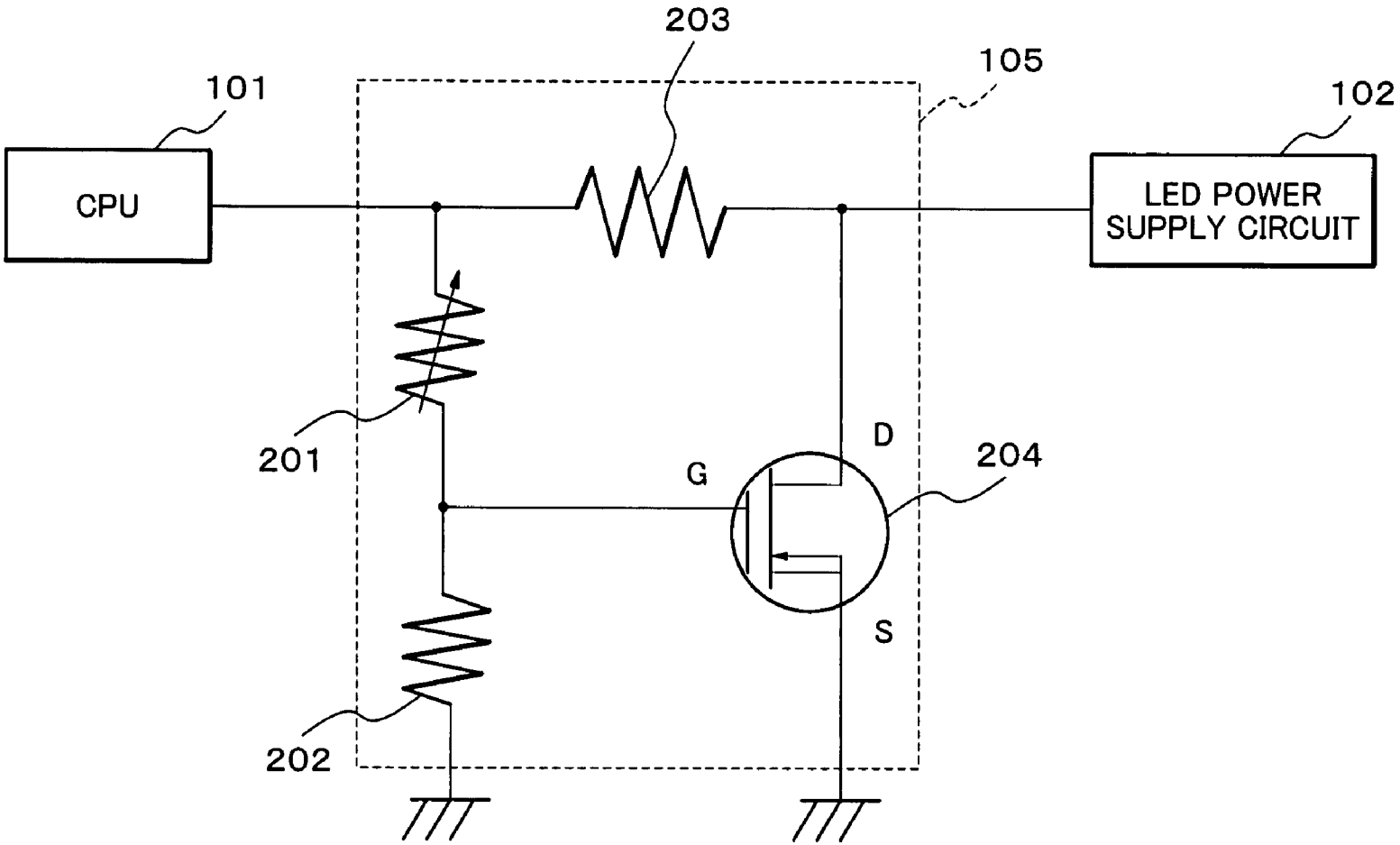
FIG. 3 is a circuit diagram, partly in block diagram, of an example of a light source monitoring circuit in the present invention.

Referring to FIG. 3, there is shown an example of the light source monitoring circuit 105. The light source monitoring circuit 105 includes a thermistor 201, a resistor 202, a resistor 203, and a field effect transistor (FET) 204. The resistor 203 is disposed between the CPU 101 and the LED power supply circuit 102. A drain of the FET 204 is connected to the LED power supply circuit 102. A source of the FET 204 is grounded. The thermistor 201 is an element for monitoring a temperature of the LED 103, and is mounted in the vicinity of the LED 103. The resistor 202 and the thermistor 201 constitute a voltage division resistor portion. A voltage drop corresponding to a ratio of a resistance value of the resistor 202 to a resistance value of the thermistor 201 is obtained based on the output (i.e., the operation control signal for the LED power supply circuit 102) from the CPU 101. The decreased output is inputted to the gate terminal of the FET 204. A predetermined voltage drop is obtained across the resistor 203 based on the operation control signal at a high level outputted from the CPU 101.

The FET 204 is an N-channel FET. When the malfunction occurs in the temperature of the LED 103, the FET 204 makes forcibly a level of the operation control signal to the LED power supply circuit 102 a low level (ground level). When the LED 103 normally operates (i.e., when the temperature of the LED 103 falls within a normal temperature range), a resistance value R1 of the thermistor 201 is much larger than a resistance value R2 of the resistor 202 (R1>>R2; in general, R1/R2>10). In such a case, the level of the output from the CPU 101 becomes nearly equal to the ground level, and the output from the CPU 101 is inputted to the gate terminal of the FET 204. At this time, the FET 204 is in an OFF state. As the temperature of the LED 103 rises, the resistance value R1 of the thermistor 201 becomes gradually small. The gate voltage of the FET 204 increases in correspondence to reduction in the resistance value R1 of the thermistor 201. When the gate voltage of the FET 204 reaches a predetermined value, an operation state of the FET 204 proceeds to an ON state. At this time, a level of the operation control signal inputted to the LED power supply circuit 102 changes from a high level to a low level. In other words, the level of the input signal to the LED power supply circuit 102 becomes a ground level. As a result, the LED power supply circuit 102 stops the electric power supply to the LED 103.

The LED 103 is turned OFF due to stop of the electric power supply thereto, and its temperature gradually reduces. The resistance value of the thermistor 201 increases along with reduction in temperature of the LED 103. As the resistance value of the thermistor 201 increases, the gate voltage of the FET 204 drops. When the gate voltage of the FET 204 becomes smaller than a predetermined value, the operation state of the FET 204 proceeds to the OFF state, and the level of the operation control signal outputted to the LED power supply circuit 103 becomes the high level. Upon reception of the operation control signal at the high level from the light source monitoring circuit 105, the LED power supply circuit 102 starts to supply the electric power to the LED 103.

As described above, the light source controlling circuit of this embodiment can suppress the temperature rise in the LED 103 within the predetermined range. Thus, when the above light source controlling circuit is mounted in the portable electric apparatus having the imaging device and the LED as the light source, the light source controlling circuit can prevent a bad influence from being exerted on other electronic circuits.

Figure 4:
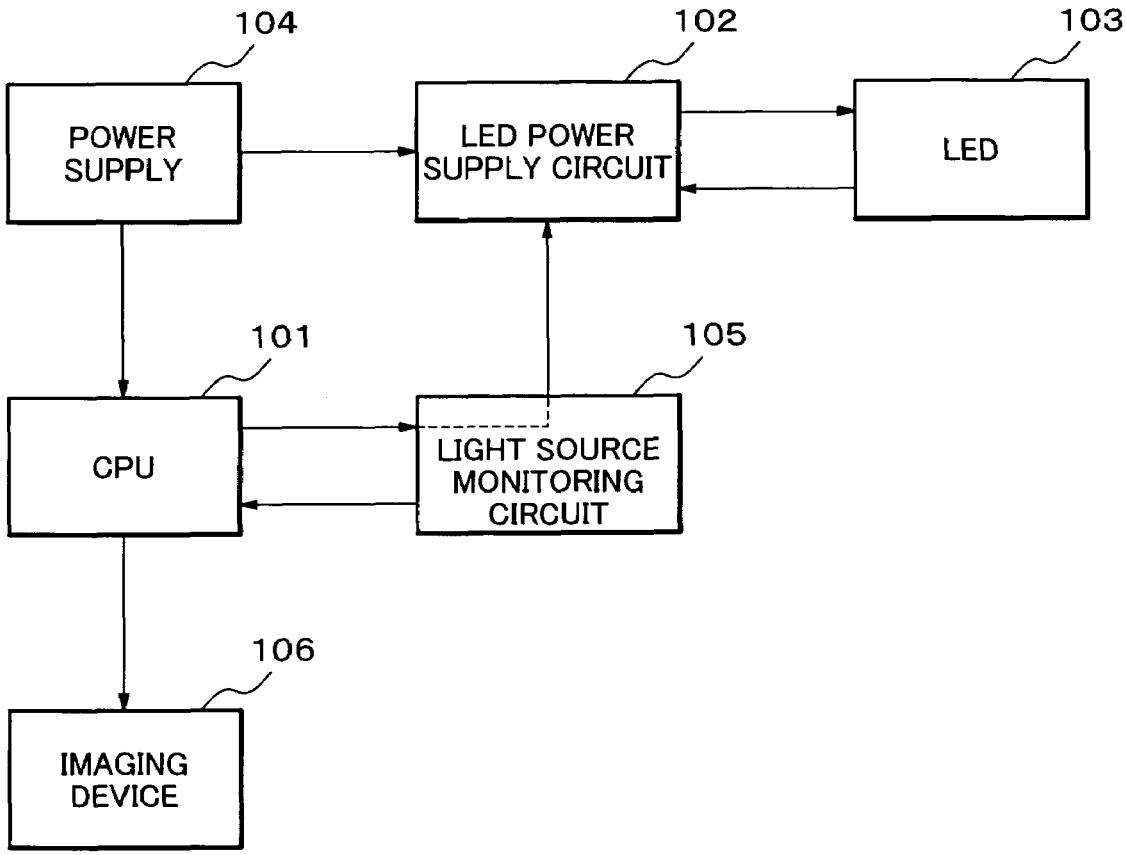
FIG. 4 is a block diagram of a light source controlling circuit according to another embodiment of the present invention.
Figure 5:
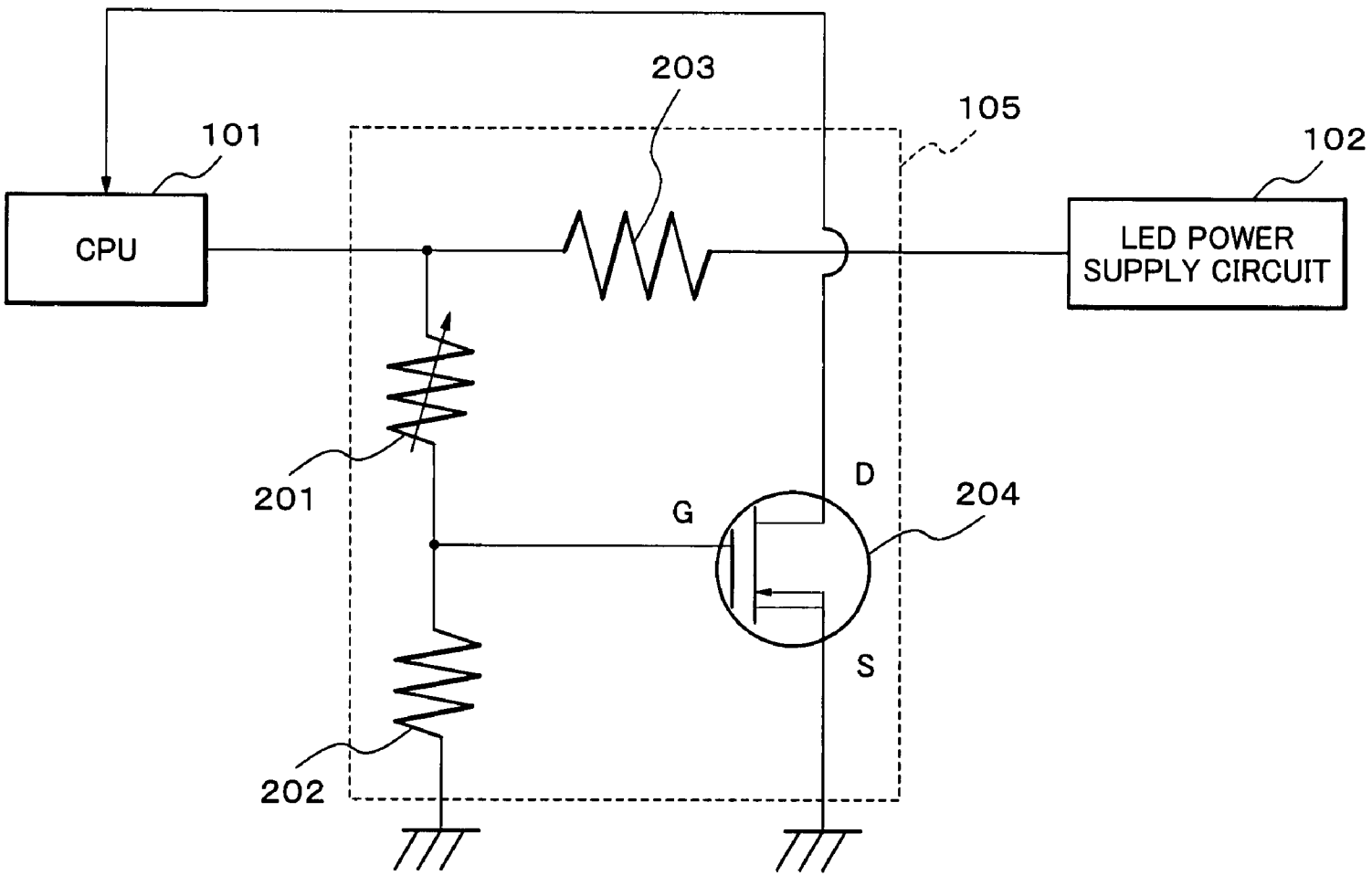
FIG. 5 is a circuit diagram, partly in block diagram, of another example of the light source monitoring circuit in the present invention.

Referring to FIG. 4, there is shown another embodiment of the light source controlling circuit of the present invention. In the light source controlling circuit, when the light source monitoring circuit 105 detects malfunction in temperature of the LED 103, the light source monitoring circuit 105 sends a reset signal to the CPU 101. FIG. 5 shows an example of the above light source monitoring circuit 105. In the light source monitoring circuit 105, a drain of the FET 204 is directly connected to the CPU 101. As the temperature of the LED 103 rises, the resistance value R1 of the thermistor 201 becomes gradually small. The gate voltage of the FET 204 increases in correspondence to reduction in the resistance value R1 of the thermistor 201. When the gate voltage of the FET 201 reaches a predetermined value, the operation state of the FET 204 proceeds to the ON state. At this time, a reset signal at a low level (at a ground level) is inputted from a drain of the FET 204 to the CPU 101. As a result, upon reception of the reset signal from the light source monitoring circuit 105, the CPU 101 resets the portable electronic apparatus in which the LED power supply circuit 102 or the CPU 101 itself is mounted to reactivate the portable electronic apparatus. For this reason, the operation state of the LED 103 proceeds from the ON state to the initial state (that is, OFF state). Since the operation state of the portable electronic apparatus returns back to the initial state, and a display portion (not shown) of the portable electronic apparatus displays information on the initial state on its screen, a user can readily recognize the malfunction of the LED 103. Moreover, when the power supply 104 doubles as a power supply for the portable electronic apparatus, it is possible to avoid that the electric power of the power supply 104 is wastefully consumed.

Figure 6:
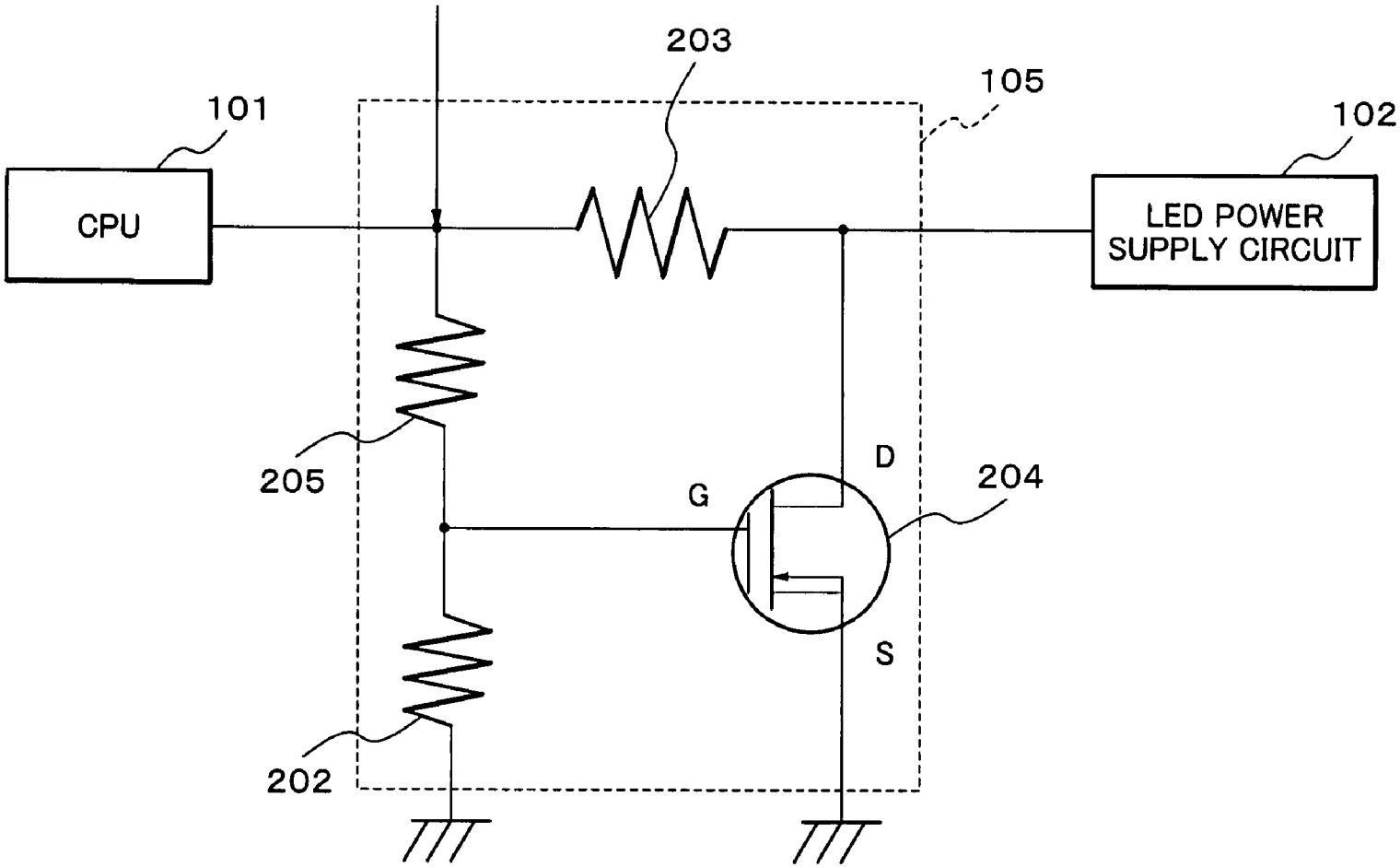
FIG. 6 is a circuit diagram, partly in block diagram, of still another example of the light source monitoring circuit in the present invention.

The malfunction of the LED 103 can be detected by utilizing a method different from the temperature measuring method. For example, if a feedback voltage outputted from the LED 103 to the LED power supply circuit 102, or a value of a current inputted to the LED 103 is monitored, the malfunction of the LED 103 can be detected. A light source monitoring circuit 105 for carrying out this method, as shown in FIG. 6, is a circuit in which the thermistor 201 in the light source monitoring circuit 105 is replaced with a resistor 205 having a predetermined resistance value. In this light source monitoring circuit 105, the above feedback voltage or current is applied to a voltage division resistor portion having the two resistors. The gate voltage of the FET 204 can be changed in correspondence to the voltage value or the current value.

In the present invention, the light source monitoring circuit described above may be configured without providing the resistor 203. The LED 103 may be configured in the form of an array having a plurality of LEDs. A suitable light source for outputting continuous light other than an LED may be applied to the present invention. The light source monitoring circuit may be applied to any portable electronic apparatus (e.g., a mobile telephone or a camera) including an imaging device.

While the present invention has been described in connection with certain preferred embodiments, it is to be understood that the subject matter encompassed by the present invention is not limited to those specific embodiments. On the contrary, it is intended to include all alternatives, modifications, and equivalents as can be included within the spirit and scope of the following claims.

Further, it is the inventor's intent to refrain all equivalents of the claimed invention even if the claims are amended during prosecution.

What is claimed is:

1. A light source controlling circuit that controls a light source that outputs continuous light, comprising:

a power supply circuit that supplies an electric power to the light source;

a light source monitoring circuit that monitors a state of the light source; and a control circuit that outputs a first control signal to control the light source;

wherein the light source monitoring circuit outputs a second control signal to control the light source in correspondence to the state of the light source, wherein the light source monitoring circuit comprises:

a first resistor disposed in series between the control circuit and the power supply circuit;

a voltage division resistor portion having a thermistor and a second resistor, the voltage division resistor portion being connected to the control circuit; and a field effect transistor having a gate terminal to which a divided voltage is inputted and a drain terminal connected to the power supply circuit.

2. A light source controlling circuit according to claim 1, wherein the first control signal is inputted to the power supply circuit through the light source monitoring circuit.

3. A light source controlling circuit according to claim 1, wherein the light source comprises a light emitting diode (LED).

4. A light source controlling circuit according to claim 1, wherein when the light source monitoring circuit detects malfunction of the light source, the light source monitoring circuit outputs the second control signal to the control circuit to stop an operation of the control circuit.

5. A light source controlling circuit according to claim 4, wherein the light source monitoring circuit comprises a temperature detecting element that detects a temperature of the light source, and when a temperature of the light source is equal to or higher than a predetermined temperature, judges that the light source malfunctions.

6. A light source controlling circuit that controls a light source that outputs continuous light, comprising:

a power supply circuit that supplies an electric power to the light source;

a light source monitoring circuit that monitors a state of the light source; and a control circuit that outputs a first control signal to control the light source;

wherein the light source monitoring circuit outputs a second control signal to control the light source in correspondence to the state of the light source, wherein the light source monitoring circuit comprises:

a first resistor disposed in series between the control circuit and the power supply circuit;

a voltage division resistor portion having a thermistor and a second resistor, the voltage division resistor portion being connected to the control circuit; and a field effect transistor having a gate terminal to which a divided voltage is inputted and a drain terminal connected to the power supply circuit, wherein when the light source monitoring circuit detects malfunction of the light source, the light source monitoring circuit outputs the second control signal directly to the power supply circuit to stop an operation of the power supply circuit.

7. A light source controlling circuit according to claim 6, wherein the light source monitoring circuit comprises a temperature detecting element for detecting a temperature of the light source, and when a temperature of the light source is equal to or higher than a predetermined temperature, judges that the light source malfunctions.

8. A light source controlling circuit that controls a light source that outputs continuous light, comprising:

a power supply circuit that supplies an electric power to the light source;

a light source monitoring circuit that monitors a state of the light source; and a control circuit that outputs a first control signal to control the light source;

wherein the light source monitoring circuit outputs a second control signal to control the light source in correspondence to the state of the light source, wherein the light source monitoring circuit comprises:

a first resistor disposed in series between the control circuit and the power supply circuit;

a voltage division resistor portion having a plurality of resistors, the voltage division resistor portion being connected to the control circuit; and a field effect transistor having a gate terminal to which a divided voltage is inputted and a drain terminal connected to the power supply circuit;

wherein the voltage division resistor portion monitors at least one of a voltage that is fed back from the light source to the power supply circuit and a current supplied to the light source.

9. A light source controlling circuit that controls a light source that outputs continuous light, comprising:

a power supply circuit that supplies an electric power to the light source;

a light source monitoring circuit that monitors a state of the light source; and a control circuit that outputs a first control signal to control the light source;

wherein the light source monitoring circuit outputs a second control signal to control the light source in correspondence to the state of the light source, wherein the light source monitoring circuit comprises:

a first resistor disposed in series between the control circuit and the power supply circuit;

a voltage division resistor portion having a thermistor and a second resistor, the voltage division resistor portion being connected to the control circuit; and a field effect transistor having a gate terminal to which a divided voltage is inputted and a drain terminal connected to the control circuit.

10. A light source controlling circuit that controls a light source that outputs continuous light, comprising:

a power supply circuit that supplies an electric power to the light source;

a light source monitoring circuit that monitors a state to the light source; and a control circuit that outputs a first control signal to control the light source;

wherein the light source monitoring circuit outputs a second control signal to control the light source in correspondence to the state of the light source, wherein the light source monitoring circuit comprises:

a first resistor disposed in series between the control circuit and the power supply circuit;

a voltage division resistor portion including a plurality of resistors, the voltage division resistor portion being connected to the control circuit; and a field effect transistor having a gate terminal to which a divided voltage is inputted and a drain terminal connected to the control circuit; and wherein the voltage division resistor portion monitors at least one of a voltage that is fed back from the light source to the power supply circuit and a current supplied to the light source.

11. A portable electronic apparatus, comprising:

an imaging device;

a light source that outputs continuous light;

a power supply circuit that supplies an electric power to the light source;

a light source monitoring circuit that monitors a state of the light source; and a control circuit that outputs a first control signal to control the light source, wherein the light source monitoring circuit outputs a second control signal to control the light source in correspondence to the state of the light source, wherein the light source monitoring circuit comprises:

a first resistor disposed in series between the control circuit and the power supply circuit;

a voltage division resistor portion having a thermistor and a second resistor, the voltage division resistor portion being connected to the control circuit; and a field effect transistor having a gate terminal to which a divided voltage is inputted and a drain terminal connected to the power supply circuit.

12. A portable electronic apparatus according to claim 11, wherein the first control signal is inputted to the power supply circuit through the light source monitoring circuit.

13. A portable electronic apparatus according to claim 11, wherein the light source comprises a light emitting diode (LED).

14. A portable electronic apparatus according to claim 11, wherein the portable electronic apparatus is a mobile telephone.

15. A portable electronic apparatus according to claim 11, wherein the control circuit controls the portable electronic apparatus.

16. A portable electronic apparatus according to claim 11, wherein when the light source monitoring circuit detects malfunction of the light source, the light source monitoring circuit outputs the second control signal to the power supply circuit to stop an operation of the power supply circuit.

17. A portable electronic apparatus according to claim 16, wherein the light source monitoring circuit comprises a temperature detecting element that detects a temperature of the light source, and when a temperature of the light source is equal to or higher than a predetermined temperature, judges that the light source malfunctions.

18. A portable electronic apparatus according to claim 11, wherein when the light source monitoring circuit detects malfunction of the light source, the light source monitoring circuit outputs the second control signal to the control circuit to stop an operation of the control circuit.

19. A portable electronic apparatus according to claim 18, wherein the light source monitoring circuit comprises a temperature detecting element that detects a temperature of the light source, and when a temperature of the light source is equal to or higher than a predetermined temperature, judges that the light source malfunctions.

20. A portable electronic apparatus comprising:

an imaging device;

a light source that outputs continuous light;

a power supply circuit that supplies an electric power to the light source;

a light source monitoring circuit that monitors a state of the light source; and a control circuit that outputs a first control signal to control the light source, wherein the light source monitoring circuit outputs a second control signal to control the light source in correspondence to the state of the light source, wherein the light source monitoring circuit comprises:

a first resistor disposed in series between the control circuit and the power supply circuit;

a voltage division resistor portion comprising a plurality of resistors, the voltage division resistor portion being connected to the control circuit; and a field effect transistor having a gate terminal to which a voltage obtained through voltage division is inputted and a drain terminal connected to the power supply circuit;

wherein the voltage division resistor portion monitors at least one of a voltage that is fed back from the light source to the power supply circuit and a current supplied to the light source.

21. A portable electronic apparatus comprising:

an imaging device;

a light source that outputs continuous light;

a power supply circuit that supplies an electric power to the light source;

a light source monitoring circuit that monitors a state of the light source; and a control circuit that outputs a first control signal to control the light source, wherein the light source monitoring circuit outputs a second control signal to control the light source in correspondence to the state of the light source, wherein the light source monitoring circuit comprises:

a first resistor disposed in series between the control circuit and the power supply circuit;

a voltage division resistor portion including a thermistor and a second resistor, the voltage division resistor portion being connected to the control circuit; and a field effect transistor having a gate terminal to which a divided voltage is inputted and a drain terminal connected to the control circuit.

22. A portable electronic apparatus comprising:

an imaging device;

a light source that outputs continuous light;

a power supply circuit that supplies an electric power to the light source;

a light source monitoring circuit that monitors a state of the light source; and a control circuit that outputs a first control signal to control the light source, wherein the light source monitoring circuit outputs a second control signal to control the light source in correspondence to the state of the light source, wherein the light source monitoring circuit comprises:

a first resistor disposed in series between the control circuit and the power supply circuit;

a voltage division resistor portion having a plurality of resistors, the voltage division resistor portion being connected to the control circuit; and a field effect transistor having a gate terminal to which a divided voltage is inputted and a drain terminal connected to the control circuit;

wherein the voltage division resistor portion monitors at least one of a voltage that is fed back from the light source to the power supply circuit and a current supplied to the light source.

* * * * *